US007681465B2

(12) United States Patent
Mismas et al.

(10) Patent No.: US 7,681,465 B2
(45) Date of Patent: Mar. 23, 2010

(54) METHOD TO PROTECT THE INTEGRITY OF SMALL ANALYTICAL SAMPLES

(76) Inventors: George Mismas, MGM Instruments Inc., 925 Sherman Ave., Hamden, CT (US) 06514; Anthony Calderoni, MGM Instruments Inc., 925 Sherman Ave., Hamden, CT (US) 06514

( * ) Notice: Subject to any disclaimer, the term of this patent is extended or adjusted under 35 U.S.C. 154(b) by 96 days.

(21) Appl. No.: 11/975,573

(22) Filed: Oct. 19, 2007

(65) Prior Publication Data

US 2009/0100943 A1 Apr. 23, 2009

(51) Int. Cl.
*B01L 3/02* (2006.01)

(52) U.S. Cl. ..... 73/864.02

(58) Field of Classification Search ..... 73/864.21, 73/864.02; 422/69, 68.1
See application file for complete search history.

(56) References Cited

U.S. PATENT DOCUMENTS 6,135,172 A * 10/2000 Fere et al. ..... 141/329
6,251,686 B1 * 6/2001 Studer et al. ..... 436/180
7,223,370 B2 * 5/2007 Moore et al. ..... 422/100

* cited by examiner

*Primary Examiner*—Hezron Williams
*Assistant Examiner*—Tamiko D Bellamy

(57) ABSTRACT

This invention provides a method to protect an analytical sample from being diluted or otherwise contaminated during the analytical procedure.

2 Claims, 1 Drawing Sheet

METHOD TO PROTECT THE INTEGRITY OF SMALL ANALYTICAL SAMPLES

FIELD OF INVENTION

Figure 1:
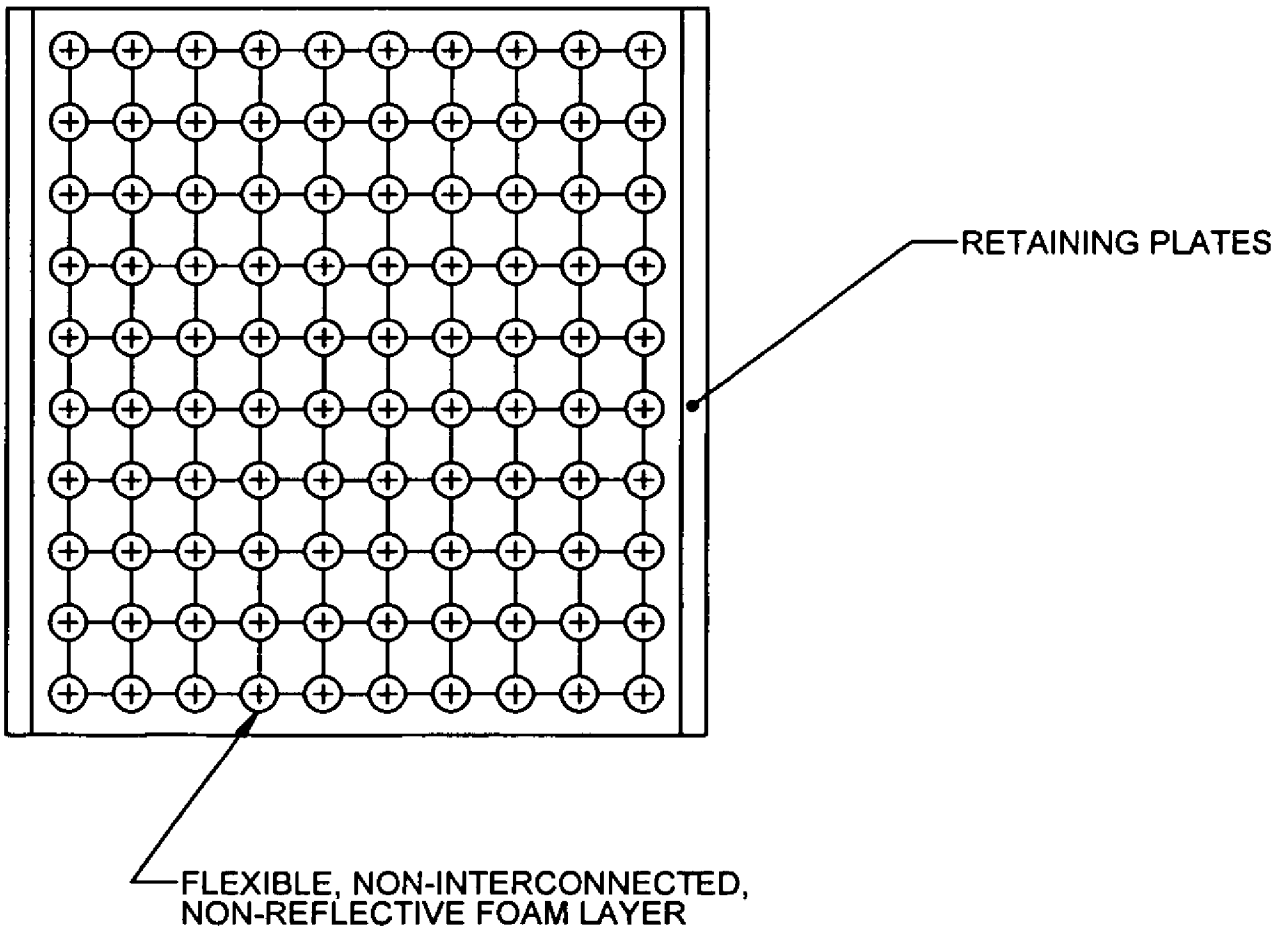

Described herein is a device to protect analytical samples and the analytical method thereof from accidental dilution or contamination.

BACKGROUND OF THE INVENTION

Over the years there have been found more and more ways the amount of a material of interest in a sample and also it is now possible to find and measure extremely small amounts off such a material. These findings in turn have made it common to analyze more and more samples such as body fluids, environmental samples, food products and the like.

With so many samples being analyzed, the development of automated systems to handle these samples have been developed. In turn, this automation also minimizes the possibility of human errors. With the need to determine smaller and smaller amounts of materials in these smaller and smaller samples, there still remains a few possibilities to have errors during these analytical procedures and this invention is designed to eliminate one of these more common possibilities.

Analytical samples, especially those involving human and animal body fluids are usually obtained by inserting a hypodermic syringe into the proper region of the body and withdrawing a given amount of fluid into the syringe and then removing the syringe from the body. The needle of the syringe is then inserted into a container, often a small test tube, through a flexible cover. The test tube is generally air evacuated so that when the syringe is drained, the fluid readily enters the test tube where it is stored.

Depending on the chemistry or biology of the sample taken, these tubes may also contain reactants or preservatives for the sample to work before the actual analysis is performed. Often samples are taken at various locations and then transferred to a laboratory where the apparatus for the automated determination of the amount of a selected ingredient can be performed.

Analytical procedures require that a specified volume of sample be removed from the collection test tube and transferred to another test tube in which the actual analysis is to be performed. This is usually done by inserting another syringe needle or pipette tip through the flexible cover of the collection test tube until the orifice in that needle or pipette tip is well below the surface of the sample liquid. A vacuum is then applied to that pipette so that a specified amount of sample liquid is withdrawn into the piper. The piper is then moved to the analytical tube and the tip is positioned near the bottom of the tube when pressure is applied to the sample therein and the sample flows into the reaction tube.

It is during this operation that a problem can arise. After the tip of the syringe or pipette has been inserted into the sample tube, there are now possibly two holes in the flexible cover. These holes are known to tear a bit so that when the sample is removed some fluid adheres to the outside of that tip. Then when the tip is placed in the analytical tube and released into it near the bottom, the analytical fluid adhering to the outside is mixed with the analytical sample material thus causing an error in the volume of fluid to be analyzed. During the analysis for very small amounts of material this dilution can cause a significant error in the results.

It is this problem that the current error addresses.

DESCRIPTION OF THE INVENTION

FIG. 1 shows the basics of this invention. The product shown there consists of two metal plates, preferably made of aluminum, which contain an array of matched holes with the same diameter as the sample storage tools being used by the analyst. Between the plates is held a sheet of a flexible material which in turn consists of two sheets of a non-reactive elastomer like Teflon between which is held a sheet of a plastic foam material in which the orifices are not interconnected. One commercial material like this is called BISCO Silicones manufactured by Rogers corporation Carol Stream, Ill.

The size of the metal late matches the working size of an automated analyzer with which it is to be used. Similarly the number of holes in the metal sheets matches the number of sample tubes which can be placed in the tube holder of that same instrument.

The product described is positioned on the upper surface of the sample tubes being used and firmly holds those tubes in place in the instrument.

When ready, a needle or pipette is lowered and pushed slowly through the Teflon material and then through the sample tube cover and then stops very near the bottom of the sample tube. The instrument then draws a vacuum on the pipette and draws the proper amount of liquid sample into it. Next the pipette is slowly withdrawn from the sample tube and as the tip passes through the Teflon material, it is thoroughly cleansed of any sample material which had adhered to the outside of the pipette.

When totally free from the product herein described, the pipette is automatically moved to an tube for the analysis and the sample is pushed from the pipette into that tube to be processed. This operation has insured that the exact volume of sample has been procured for analysis.

This operation is repeated for each sample tube held in the instrument or an instrument can be so configured that all sample tubes in the instrument can be processed simultaneously.

We claim:

1. A method of removing an exact liquid sample from a sample holding tube by placing a rigid plate having holes therein which are sealed by a Teflon type material which material can be pierced by a pipette tip held in place by an analytical instrument, and a. that pipette tip is lowered into the sample tube and withdraws an exact sized liquid sample and b. the pipette is slowly removed from the sample tube as the Teflon like material thoroughly removes any liquid residue from the pipette and c. the pipette tip can then be moved to an analytical tube for processing.

2. The method of claim 1 wherein the Teflon type material is a BISCO Silicone.

* * * * *